US007856747B2

(12) United States Patent
Haubrich

(10) Patent No.: US 7,856,747 B2
(45) Date of Patent: Dec. 28, 2010

(54) INFORMATIONAL STOP SIGN

(76) Inventor: William Haubrich, 25 Washington St., Concord, NH (US) 03301

( * ) Notice: Subject to any disclaimer, the term of this patent is extended or adjusted under 35 U.S.C. 154(b) by 148 days.

(21) Appl. No.: 12/366,183

(22) Filed: Feb. 5, 2009

(65) Prior Publication Data

US 2009/0139125 A1 Jun. 4, 2009

Related U.S. Application Data

(63) Continuation-in-part of application No. 29/292,988, filed on Nov. 7, 2007, now Pat. No. Des. 588,037.

(51) Int. Cl.
*G09F 7/00* (2006.01)

(52) U.S. Cl. ..... 40/612; 40/606.19; 116/63 R

(58) Field of Classification Search ..... 40/606.19, 40/612; 116/63 R
See application file for complete search history.

(56) References Cited

U.S. PATENT DOCUMENTS 1,327,387 A * 1/1920 Hockaday ..... 40/612
1,352,065 A * 9/1920 Hottenstein ..... 40/607.02
1,497,958 A * 6/1924 Swinford ..... 40/612
1,517,439 A * 12/1924 Like ..... 40/612
2,272,322 A * 2/1942 Kiecker ..... 40/612
2,834,133 A * 5/1958 Carmack ..... 40/612
D305,212 S * 12/1989 Rowebottom ..... D10/109
D331,718 S 12/1992 Walker
D399,260 S 10/1998 Thimote
D405,377 S 2/1999 Davis
6,519,884 B1 * 2/2003 Duhamel ..... 40/612
6,550,731 B1 * 4/2003 Kim ..... 248/223.41
D482,073 S 11/2003 Nakajo et al.
2008/0016737 A1 * 1/2008 Williams ..... 40/612

* cited by examiner

*Primary Examiner*—Gary C Hoge
(74) *Attorney, Agent, or Firm*—Robert R. Deleault, Esq; Mesmer & Deleault, PLLC

(57) ABSTRACT

An informational stop sign has an octagonal center portion, a primary traffic symbol in the center of the octagonal center portion wherein the primary traffic symbol is the word STOP displayed within the center portion, a plurality of rectangular portions extending radially outward from and perpendicular to the periphery of the center portion, each of the plurality of rectangular portions corresponding to a location of an inlet of a traffic intersection, and an Arabic numeral displayed within at least one of the plurality of rectangular portions indicating an inlet to the traffic intersection having a stop sign, the Arabic numeral being the number of inlets to the traffic intersection having a stop sign.

16 Claims, 6 Drawing Sheets

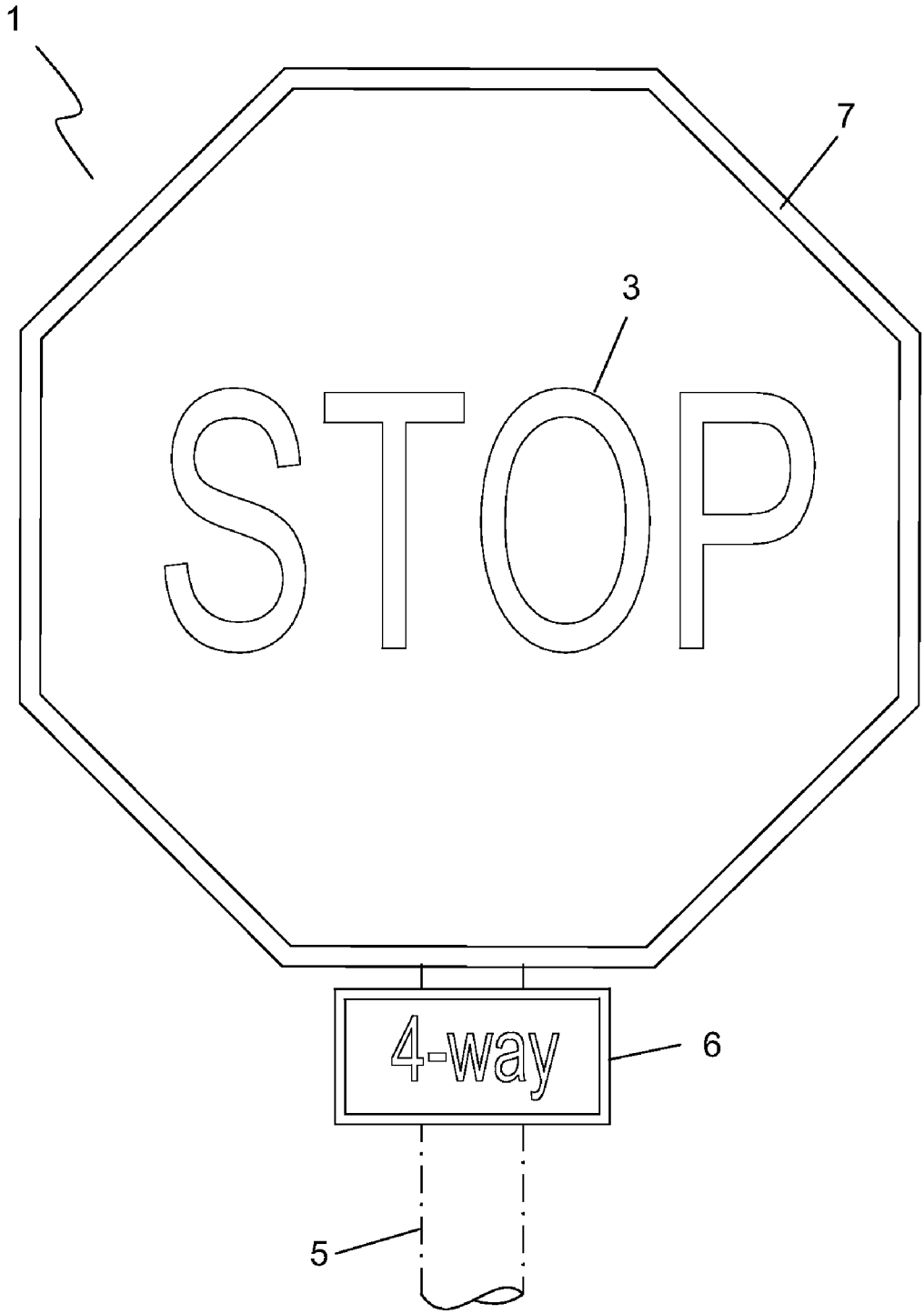
*Figure 6 - Prior Art*

INFORMATIONAL STOP SIGN

This application is a continuation-in-part application of Ser. No. 29/292,988 filed on Nov. 7, 2007.

BACKGROUND OF THE INVENTION

1. Field of the Invention

The invention relates to signs used for vehicle traffic control on public roads.

2. Description of the Prior Art

Various known, standard traffic signs are disclosed in the "Manual on Uniform Traffic Control Devices for Streets and Highways," 2003 edition with Revision 1 dated November 2004 and Revision 2 dated December 2007, published by the U.S. Department of Transportation under the Federal Highway Administration. The Manual places known highway signs in three categories. These categories are regulatory signs, warning signs and guide signs. Regulatory signs inform drivers of traffic laws and regulations. Warning signs warn drivers of traffic of unusual or potentially hazardous conditions on or adjacent a street or highway. Guide signs give the driver simple and specific information to aid the driver in reaching a destination. In all categories and particularly in the regulatory and warning categories, the signs convey only one traffic message. No secondary traffic message or information is imparted by the signs.

The stop sign is a mostly uniform regulatory traffic sign in use throughout the United States. An example of a standard stop sign 1 with is illustrated in FIG. 6. Standard stop sign 1 is typically a red octagon with a white legend 3 and border 7. The word STOP in white letters is the legend 3 and it is in the middle portion 2 of the sign 1. The signs are placed at traffic intersections to require motorists to stop before entering the intersection. Its purpose is to give the motorist time to examine the intersection for interfering traffic before passing through. Stop signs are typically placed and used to increase safety.

However, there are shortcomings to using a single type of stop sign for all type of intersections. With the standard stop sign, it is difficult, if not impossible, for a driver to determine from the sign if there is any particular secondary traffic situation nearby that may present a danger. Some intersections have four-way stops, some have more, and some have fewer. There are intersections at which not all of the inlets have stop signs, and particular inlets have a right of way. A driver cannot tell this until the driver reaches the intersection who might have the right-of-way. This can cause driver confusion and therefore accidents.

One solution that has been used most often has been to add a small tag below the octagon stating the number of directions having a stop sign. They usually say "2-WAY", "3-WAY", or "4-WAY" to indicate the number of directions that have to stop. FIG. 6 also illustrates such a typical secondary legend 6. While that is an improvement, there is a great probability that a viewer in a moving vehicle will not notice it in time to take action. It is well known that drivers receive information faster if it is graphical as opposed to only text. Examples of such graphical information are the signs containing a "U" with a superimposed circle with a diagonal line to indicate no "U" turn permitted. The symbol conveys the same information and is comprehended more quickly by a driver than the words "No U-turn". This is especially so for someone who has difficulty reading English.

Various other types of stop signs have been disclosed. U.S. Pat. No. D399,260 (1998, Thimote) discloses a traffic sign system. It is a design patent and the drawings disclose an octagon shaped sign with a border and a legend in the lower half of the sign and one or more arrows in the upper half of the sign. The purpose of the right and left arrows on the stop sign is not described. Thimote teaches a stop sign that has a left arrow, a right arrow, and a left and right arrow, and nothing else. The meaning of each embodiment is ambiguous, since it could mean either that a driver could go towards that direction, or to look out for traffic from that direction.

U.S. Pat. No. 6,519,884 (2004, Duhamel) discloses a street and road sign. Duhamel teaches the use of secondary traffic symbols placed within the primary stop sign to generally indicate which inlets at the intersection have stop signs. While this is an improvement over the prior art, this stop sign cannot property indicate the status of an inlet that is at some orientation to the intersection other than 0, 90, or 270 degrees from the viewer. There is insufficient room within the boundaries of the octagonal stop sign to accurately and clearly represent other orientations. Furthermore, unless all stop signs in the country are changed simultaneously, a viewer of an older stop sign without any secondary stop signs would be forced to assume that each intersection inlet would have the right of way over the viewer. This would be a disadvantage.

Therefore, what is needed is an informational stop sign that graphically and accurately shows the position and right-of-way status of each inlet to an intersection.

SUMMARY OF THE INVENTION

It is object of the present invention to provide on a known traffic sign secondary traffic information to a driver to observe or watch for in the general area where the sign is located. It is another object of the present invention to provide an information stop sign with a readily visible characteristic other than the primary traffic information provided in the form of wording on the sign.

The present invention achieves these and other objectives by providing an informational stop sign that includes an octagonal center portion, a primary traffic symbol in the center of the octagonal center portion, a plurality of rectangular portions that extend radially outward from and perpendicular to the periphery of the center portion, and an Arabic numeral displayed within at least one of the plurality of rectangular portions. The primary traffic symbol in the center of the octagonal center portion is the word STOP. Each of the plurality of rectangular portions corresponds to a location of an inlet of a traffic intersection. The Arabic numeral displayed on the surface of a rectangular portion indicates an inlet to the traffic intersection that has a stop sign where the Arabic numeral represents the total number of inlets to the traffic intersection that has stop signs. It should be understood that an inlet that does not have a stop sign may also be represented by an absence of a rectangular portion to signify a right of way for vehicles approaching the intersection from those directions.

The background color of the rectangular portions is similar to the background color of the octagonal center portion. For those inlets to the traffic intersection that do not have a stop sign, the rectangular portion has no Arabic numeral and may optionally include a background color that is different from the background color of the octagonal center portion. Typically, stop signs have a red background color. The different background color optionally used in a rectangular portion representing an inlet to the traffic intersection that does not have a stop sign may be any contrasting color, but, preferably, it is the color green. The color green represents "go" for traffic lights and the meaning of a green light indicates to the vehicles on the roadway having the green light that they also have the right-of-way for so long as the light remains green. By using the color green as the background color for the rectangular portion representing the inlet that has no stop sign would further reinforce the notice and information provided by a rectangular portion that has no Arabic numeral, which is that the inlet has no stop sign. The use of the optional, contrasting color would provide a driver easy and quick visual notice about that inlet into the intersection without having to look at the inlet to see if there is a stop sign located adjacent that inlet.

The rectangular portions may extend from any one of the octagonal sides of the conventional stop sign. For instance, in addition to rectangular portions extending from the 0°, 90°, 180°, and 270° locations on the peripheral edge of the octagonal stop sign (the 180° location being at the bottom of an upstanding stop sign and representing the inlet adjacent to which the stop sign is located), there may also be rectangular portions extending from any one of the 45°, 135°, 225°, and 315° locations. As with conventional stop signs, the present invention may optionally include a border around the outer peripheral edges of the octagonal center portion and the rectangular portions. The border also preferably has a color that is in contrast to the background color of the octagonal center portion and the rectangular portions.

The rectangular portions have a pair of parallel sides that extend transversely away from the periphery of the octagonal center portion with an end side connected and transverse to the pair of parallel sides. In one embodiment of the rectangular portions, the end side is the same length as a side of the periphery of the octagonal center portion.

In another embodiment of the present invention, there is provided an informational sign kit. The kit includes a plurality of rectangular portions and a plurality of secondary traffic symbols. Each rectangular portion has a pair of parallel sides where one of the pair of parallel sides is no greater than the length of a side of the octagonal edge of a conventional stop sign. The secondary traffic symbols are attachable to the front of the rectangular portions. One of the pair of parallel sides of the rectangular portions is connectable to an octagonal edge of the conventional stop sign with fasteners. The position of the octagonal edge that receives the connectable rectangular portion indicates the relative position of one of the inlets in the intersection to the roadway having the stop sign. A major advantage of the kit is that existing, conventional stop signs can be modified/upgraded to the informational stop sign without having to replace the existing conventional stop sign. The rectangular portions can simply be attached to the peripheral edge of the relevant octagonal side of the convention stop sign.

In another embodiment of the kit, the rectangular portion edge that is to be attached to the edge of the conventional stop sign may include preformed fastener openings. The kit may optionally be provided with the fasteners to be used for connecting the rectangular portions to the conventional stop sign. The secondary symbols are preferably Arabic numerals and represent not only the number of inlets to the intersection that have a stop sign but also indicate the location of the inlet with the stop sign relative to the roadway on which the stop sign is placed.

In still another embodiment of the present invention, a method is disclosed for indicating the inlets to a traffic intersection having a stop sign. The method includes forming a plurality of rectangular portions that extend away from and perpendicular to a side of an octagonal stop sign at a location around the periphery of the octagonal stop sign that indicates the relative position of the inlets to the intersection at which a roadway with the stop sign abuts, and disposing a secondary traffic symbol on the surface of those rectangular portions to represent inlets with stop signs. In one embodiment, the secondary traffic symbols are self-adhesive Arabic numerals where the Arabic numeral selected represents the number of inlets in the intersection having a stop sign. In another embodiment, secondary traffic symbols are background colors that contrast with the background color of the stop sign and are applied to the front surface of the rectangular portion for those inlets that do not have a stop sign. The color is preferably green to signify that the particular inlet has the right-of-way.

BRIEF DESCRIPTION OF THE DRAWINGS

FIG. 6 is an illustration of a prior art stop sign.

DETAILED DESCRIPTION OF THE PREFERRED EMBODIMENT

Figure 1:
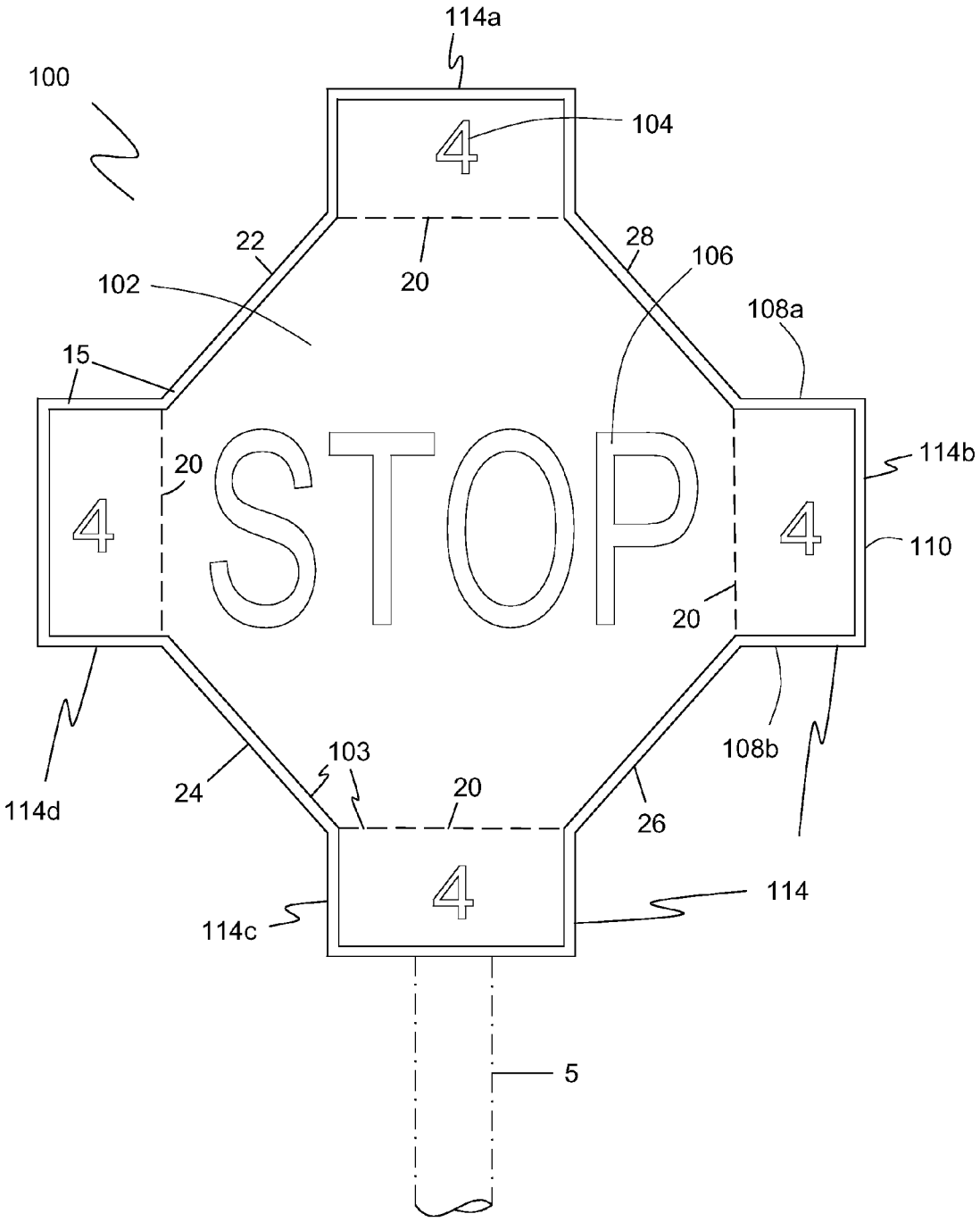
FIG. 1 is one embodiment of the present invention showing an informational stop sign indicating a four-inlet intersection with a four-way stop.

The preferred embodiments of the present invention are illustrated in FIGS. 1-5. FIG. 1 illustrates one embodiment of an informational stop sign 10 of the present invention. Informational stop sign 10 includes an octagonal center portion 102, a primary traffic symbol 106 that is the word "STOP" displayed within the center portion 102, and at least one rectangular portion 114 extending radially outward from an edge 103 of octagonal center portion 102 perpendicular to an octagonal side. Octagonal center portion 102 is that portion of stop sign 10 bounded by a plurality of dashed lines 20 (which are not part of the sign) and sign edges 22, 24, 26, 28. Each rectangular portion 114 corresponds to an orientation of an inlet into a traffic intersection. Stop sign 10 is typically constructed of sheet aluminum or other suitable material. Primary traffic symbol 106 immediately conveys to an approaching driver that a stop is required where the sign is located. Stop sign 10 is typically attached in an upstanding position to a post 5 shown in dotted lines. Bolts and nuts, screws and/or rivets and other fasteners known to those skilled in the art are used to fix stop sign 10 to post 5, depending on the kind of post used. Posts may be a metal channel, section or tube that is galvanized and/or painted. In general, stop sign 10 is located on the right side of the roadway with the front of the sign facing the oncoming traffic.

In this embodiment, one rectangular portion 114 is always at the 180 degree position of stop sign 10, which is the bottom or lowest octagonal side of stop sign 10 when top sign 10 is oriented in the upstanding position. This 180-degree position represents the inlet position of a stop sign viewer, i.e. the roadway that has stop sign 10. It is possible to omit this rectangular portion 114 in another embodiment of the present invention since this position could always represent the roadway that has stop sign 10. It should be also understood that in another embodiment of the present invention, only those inlets to an intersection that have a stop sign have rectangular portions displayed on the stop sign.

A secondary traffic symbol 104 on the front of stop sign 10 provides an approaching driver with secondary traffic information. This secondary traffic symbol 104 is unrelated to primary traffic symbol 106 provided by the word STOP. Secondary traffic symbol 104, which is preferably an Arabic numeral, is displayed within each rectangular portion 114 that represents an inlet to the traffic intersection having a stop sign. The Arabic numeral represents the number of inlets to the traffic intersection having a stop sign. FIG. 1 is an example of one embodiment of a stop sign for a four-way stop at a four-inlet intersection. Therefore, the Arabic numeral of the secondary traffic symbol 104 is a "4". The inlets are represented by a rectangular portion 114*a* located a the zero degree (0°) position, a rectangular portion 114*b* located at the ninety degree (90°) position, a rectangular portion 114*c* located at the one hundred eighty degree (180°) position, and a rectangular portion 114*d* located at the two hundred seventy degree (270°) position.

The typical construction of the present invention involves covering the front of stop sign 10 with a self-adhesive, reflective film, which could be printed or painted, and treated to provide a light reflecting surface or to be otherwise luminous for readily seeing stop sign 10 at night. The color is any color prescribed by the highway authority. The primary traffic symbol 106 is preferably a contrasting color to make the primary traffic symbol stand out from the background color of the front of stop sign 10. The peripheral border 15 of stop sign 10 is also any contrasting color prescribed by the highway authority that is distinctive and noticeable. Peripheral border 15 can also be made reflective or luminous to enhance visibility to an approaching driver.

Preferably, the octagonal center portion 102 and each rectangular portion 114 that represents an inlet to the traffic intersection having a stop sign is colored red. Optionally, the octagonal center portion 102 and rectangular portions 114 can also have a white border 112 that is preferably 0.75 inches wide for good contrast and visibility. Primary traffic symbol 106 (i.e. the word STOP) is preferably about ten inches high. Secondary traffic symbol 104 (i.e., the Arabic numerals) are preferably about four inches high.

Each rectangular portion 114 includes two parallel legs/edges 108*a*, 108*b* positioned substantially parallel and equidistant to a radial axis of each rectangular portion 114. Each parallel leg/edge terminates at a transverse or end leg/edge 110 positioned perpendicular to the two parallel legs/edges. Each end leg/edge 110 can be the same length as a side of the octagonal center portion 102. The two parallel legs 108*a*, 108*b* are preferably about six inches in length. The end legs 110 are preferably twelve inches in length.

Figure 2:
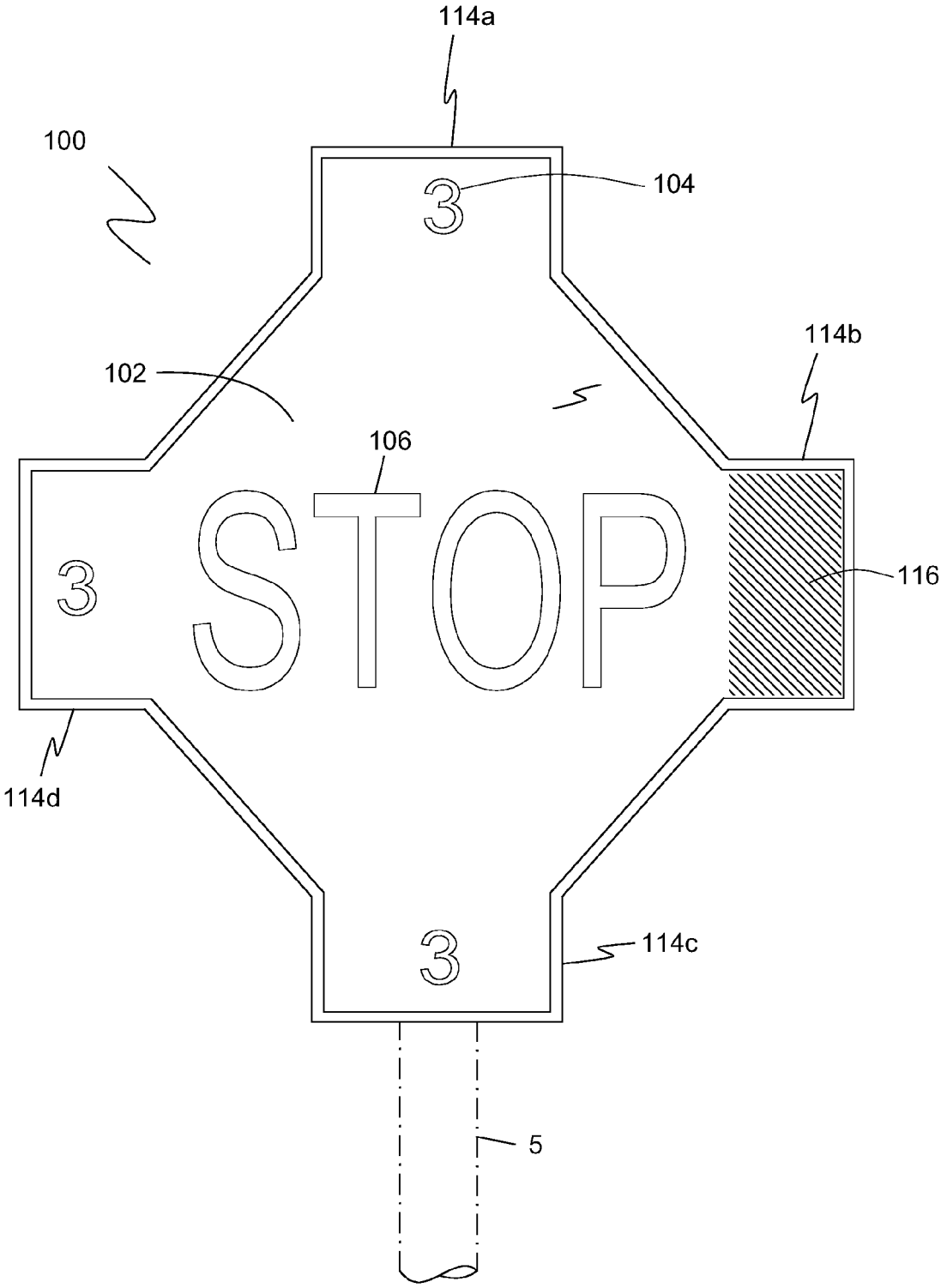
FIG. 2 is another embodiment of the present invention showing an informational stop sign indicating a four-inlet intersection with a three-way stop.

FIG. 2 shows an informational stop sign 10 according to the present invention indicating a four-inlet intersection with a three-way stop. In this embodiment of the present invention, secondary traffic symbol 104 is the Arabic numeral "3". The inlets having stop signs are represented by the rectangular portions 114 at 0 degrees 114*a*, 180 degrees 114*c*, and 270 degrees 114*d*. The inlet having no stop sign, and therefore having the right of way, is the inlet at 90 degrees 114*b*, which has no secondary traffic symbol 104. In the preferred embodiment, the background color 116 of rectangular portion 114*b* is a color that is distinctive from the background color of stop sign 10 and noticeable. The preferred color is green because of that color's association with "go" under most, if not all, traffic rules worldwide.

Figure 3:
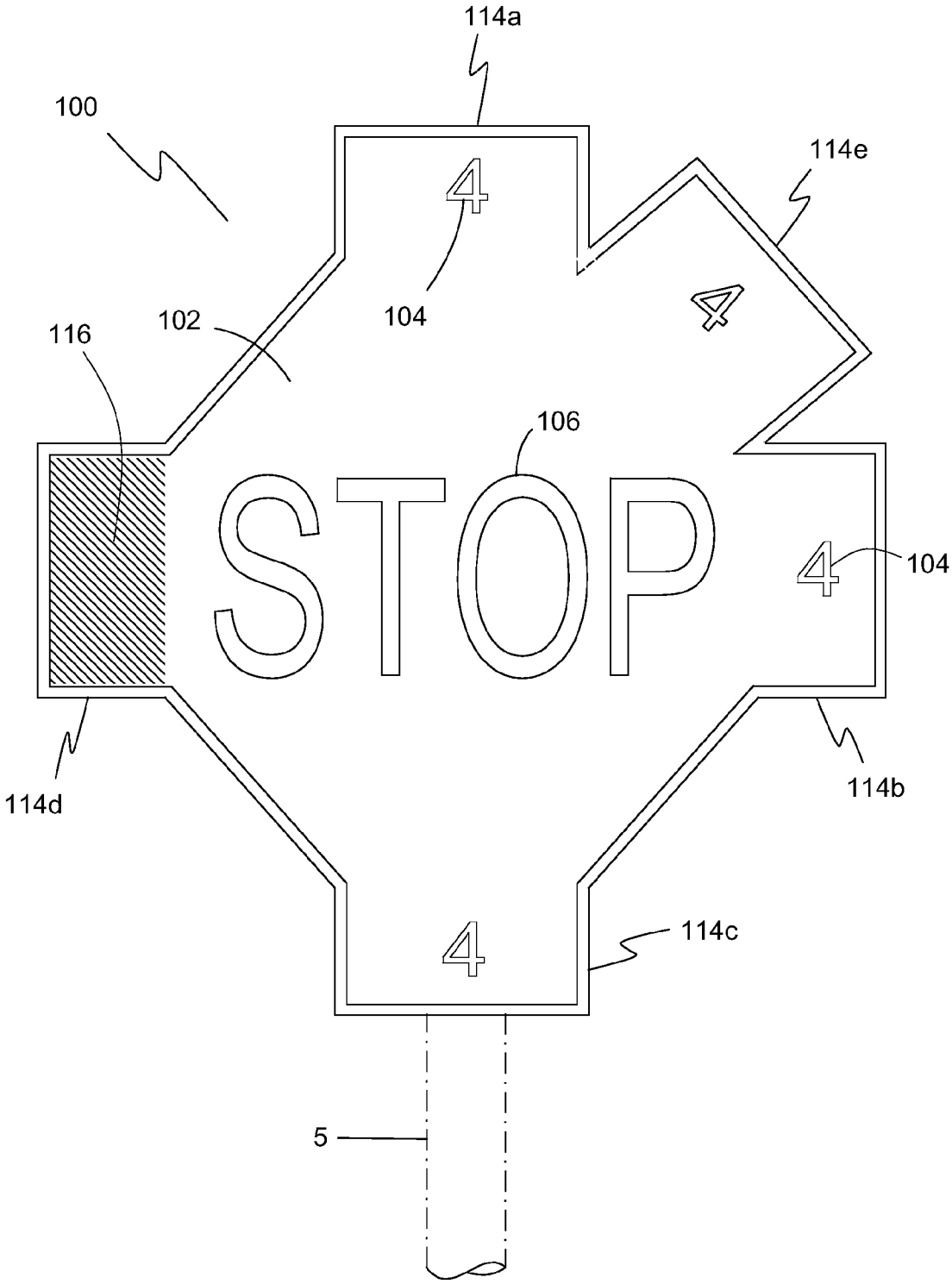
FIG. 3 is another embodiment of the present invention showing an informational stop sign indicating a five-inlet intersection with a four-way stop.

FIG. 3 shows an informational stop sign 10 according to the present invention indicating a five-inlet intersection with a four-way stop. Like FIG. 2, there is one inlet having no stop sign and it is represented by rectangular portion 114*d* located at the 27° degree position. However, this intersection has an additional inlet, which is represented by a rectangular portion 114*e* located at a forty-five degree (45°) position. According to the present invention, stop sign 10 may include one or more rectangular portions 114 at positions selected from the group consisting of 45, 135, 225, and 315 degrees in addition to the previously described locations around the peripheral edge of octagonal portion 102.

Figure 4:
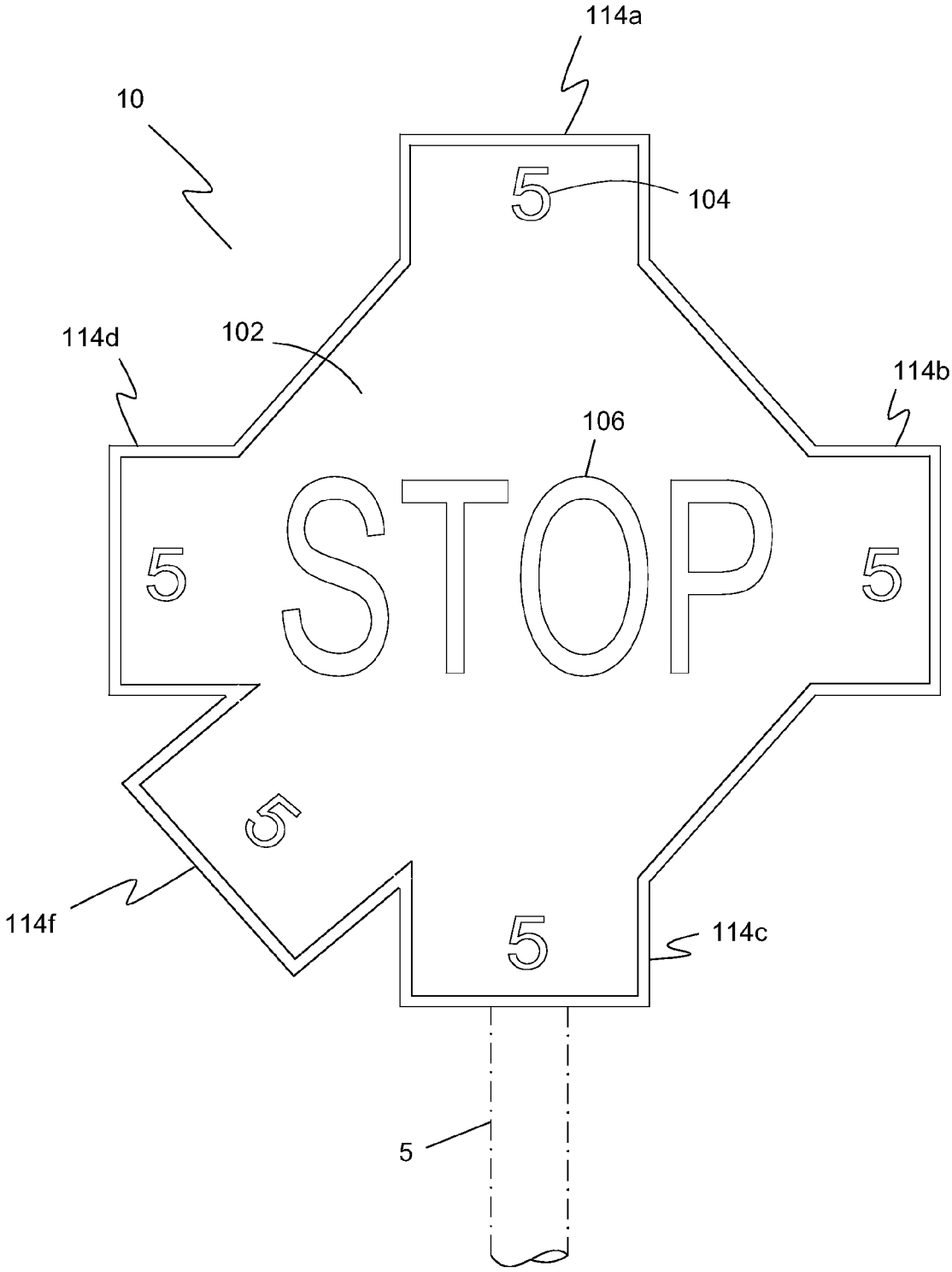
FIG. 4 is another embodiment of the present invention showing an informational stop sign according to the present invention indicating a five-inlet intersection with a five-way stop.

FIG. 4, like FIG. 3, shows an informational stop sign 10 according to the present invention indicating a five-inlet intersection, but with a five-way stop. Therefore, secondary traffic symbol 104 is the Arabic numeral "5". Here, the fifth inlet is represented by rectangular portion 114*f* located at the 225 degree position. It can be seen from the illustrated embodiments that many different combinations of inlets with and without stop signs can be presented.

Figure 5:
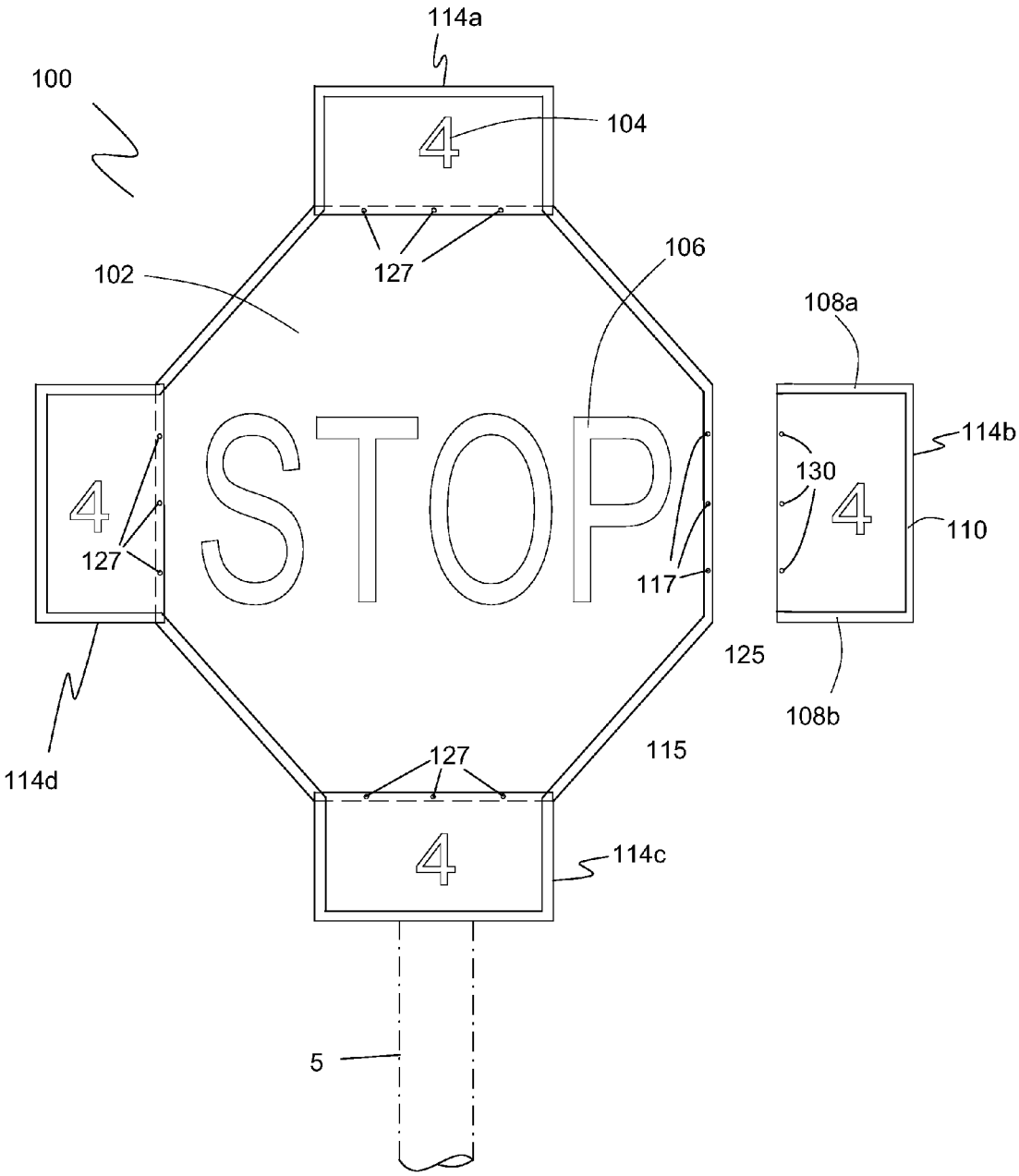
FIG. 5 is another embodiment of the present invention showing an informational stop sign assembly with attachable extensions for indicating an inlet.

Turning now to FIG. 5, there is illustrated another embodiment of informational stop sign 10 of the present invention. In this embodiment, stop sign 10 is a system or kit that includes a typical, octagonally-shaped stop sign of conventional design that forms octagonal central portion 102 and a plurality of rectangular portions 114 that are connectable to the peripheral edge 115 of octagonal central portion 102. Rectangular portions 114*a-d* may optionally have a plurality of fastener openings 130 that are positioned along a rectangular portion edge 125. Fastener openings 130 correspond and align with peripheral edge openings 117 of octagonal central portion 102. Peripheral edge openings 117 may be preformed in octagonal central portion 102, or may be knock-outs or may simply be indications where a fastener opening needs to be made. It should be understood that octagonal central portion may not have any peripheral edge opening indications whatsoever and a user of the kit may simply need to align a rectangular portion with an appropriate side of the octagonal center portion and mark the location for making the fastener openings.

Rectangular portions 114*a-d* may be fixedly attached in front of or behind octagonal central portion 102. It should be understood that peripheral edge openings 117 and fastener openings 130 may be incorporated into the peripheral edge 115 and rectangular portion edge 125 during manufacturing of octagonal portion 102 and rectangular portions 114, respectively, or they may be made at the time of installation of stop sign 10 at an appropriate roadway location. In addition, secondary traffic symbol 104 may also be applied to rectangular portions 114 during installation of stop sign 10. In this way, an installer need only have a plurality of Arabic numerals such as "2," "3," "4," "5," and the like so that the appropriate secondary traffic symbol 104 is applied to the appropriate rectangular portion for the particular intersection. Applying secondary traffic symbol 104 at the time of installation on the roadway decreases the amount of inventory of rectangular portions 114 required since such rectangular portions 114 can be universally used for all intersections regardless of the number of inlets. The correct number can be applied to the rectangular portions 114 when needed.

The absence of a secondary traffic symbol 104 within the area of rectangular portion 114 indicates that the inlet to the intersection represented by such a rectangular portion does not have to stop. Further, a plurality of self-adhesive color backgrounds for application to rectangular portions 114 may optionally be provided so that the installer may also apply a color background such as one that is green to a rectangular portion 114 that signifies an inlet to the intersection that does not have a stop and has the right-of-way.

A kit containing a plurality of rectangular portions 114 and a plurality of secondary traffic symbols 104 can be provided for modifying existing, conventional, octagonal stop signs and may be the most cost effective method of upgrading existing stop signs. The kit may optionally include fasteners 127 for fixedly securing rectangular portions 114 to the conventional stop sign and/or a plurality of self-adhesive background color sheets 116 for applying to the rectangular portions 114 to signify an inlet that does not have a stop sign.

The visual effect of stop sign 10 of the present invention provides a number of advantages over the existing art. It provides several visual cues that aid a driver to quickly assess the type of intersection he/she has approached relative to the roadway the driver is on. Each inlet is indicated by a rectangular portion 114 that extends from the peripheral edge 115 of octagonal central portion 102, thus, alerting the driver to the number of inlets in the intersection and the relative position of those inlets. Each inlet with a stop sign is further indicated by a secondary traffic symbol 104 in the respective rectangular portion 114. The driver not only knows where the other inlets are located relative to the inlet of the roadway the driver is on also quickly informed by the secondary traffic symbol 104 which of those other inlets also has stop signs. Another visual cue is the absence of a secondary traffic symbol 104 in one of the rectangular portions 114, which quickly alerts the driver that the particular inlet represented by that rectangular portion 114 does not have a stop sign and has the right-of-way through the intersection relative to the other inlets of the intersection. Since a picture is worth a thousand words, the visual cues allows a driver to quickly assess the danger potentially lurking at the intersection and to be vigilant with respect to the inlets, their locations, and the traffic rules governing vehicles approaching the intersection from those other inlets.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An informational stop sign comprising:

an octagonal center portion;

a primary traffic symbol in the center of the octagonal center portion wherein the primary traffic symbol is the word STOP displayed within the center portion;

a plurality of rectangular portions extending radially outward from and perpendicular to the periphery of the center portion, each of the plurality of rectangular portions corresponding to a location of an inlet of a traffic intersection; and an Arabic numeral displayed within at least one of the plurality of rectangular portions indicating an inlet to the traffic intersection having a stop sign, the Arabic numeral being the number of inlets to the traffic intersection having a stop sign.

2. The sign of claim 1 wherein each rectangular portion of the plurality of rectangular portions that represents an inlet to the traffic intersection having a stop sign has a background color similar to a background color of the octagonal center portion.

3. The sign of claim 2 wherein each rectangular portion of the plurality of rectangular portions that represents an inlet into the traffic intersection that does not have a stop sign has a background color different from the background color of the octagonal center portion.

4. The sign of claim 3 wherein the center portion and each rectangular portion that represents an inlet to the traffic intersection having a stop sign is colored red, and each rectangular portion that represents an inlet into the traffic intersection that does not have a stop sign is colored green.

5. The sign of claim 3 further comprising a border around the peripheral edge of the octagonal center portion and the rectangular portions that has a color in contrast to the background color of the octagonal center portion and the rectangular portions.

6. The sign of claim 5 wherein the border is white.

7. The sign of claim 1 wherein the plurality of rectangular portions is equal to four with each rectangular portion extending from the peripheral edge of the octagonal central portion at the 0, 90, 180, and 270 degree locations.

8. The sign of claim 7 further comprising at least one or more rectangular portions extending from the peripheral edge of the octagonal center portion at a position selected from the group consisting of 45, 135, 225, and 315 degrees.

9. The sign of claim 1 wherein each rectangular portion has a pair of parallel sides extending transversely away from the periphery of the octagonal center portion and an end side transverse to the pair of parallel sides.

10. The sign of claim 9 wherein the end side is the same length as a side of the periphery of the octagonal center portion.

11. An informational stop sign kit comprising:

a plurality of rectangular portions having a pair of parallel sides wherein one of the pair of parallel sides is no greater than the length of a side of an octagonal edge of a conventional stop sign; and a plurality of secondary traffic symbols attachable to a front surface of the plurality of rectangular portions wherein the plurality of secondary traffic symbols is an Arabic numeral representing the number of inlets to the intersection having a stop sign, the one of the pair of parallel sides of each of the plurality of rectangular portions being connectable to an octagonal edge of the conventional stop sign wherein the position of the octagonal edge to receive the connectable rectangular portion indicates a relative position of one of the inlets in the intersection to the roadway with the conventional stop sign.

12. The kit of claim 11 wherein the one of the pair of parallel sides of each of the plurality of rectangular portions has a plurality of fastener openings positioned for attaching the rectangular portion to an octagonal side of the conventional stop sign.

13. A method of indicating inlets to a traffic intersection having a stop sign, the method comprising:

forming a plurality of rectangular portions that extend away from and perpendicular to a side of an octagonal stop sign at a location around the periphery of the octagonal stop sign that indicates the relative position of the inlets to the intersection at which a roadway with the stop sign abuts; and disposing a secondary traffic symbol on a front surface of each of the plurality of rectangular portions that represent inlets with a stop sign.

14. The method of claim 13 further comprising applying a secondary traffic symbol to each of the plurality of rectangular portions representing an inlet of the intersection with a stop sign wherein the secondary traffic symbol is an Arabic numeral indicative of the number of inlets on the intersection having a stop sign.

15. The method of claim 13 further comprising applying a background color to each of the plurality of rectangular portions representing an inlet of the intersection without a stop sign, the background color being a contrasting color to the background color of the stop sign.

16. The method of claim 13 wherein the forming step includes connecting one peripheral edge of the rectangular portion to a side of the octagonal stop sign.

* * * * *